US008994603B2

(12) United States Patent
Harel et al.

(10) Patent No.: US 8,994,603 B2
(45) Date of Patent: Mar. 31, 2015

(54) CROSS POLARIZATION MULTIBAND ANTENNA

(75) Inventors: Jean-Pierre Harel, Lannion (FR); Patrick Lecam, Lannion (FR); Jérome Plet, Lannion (FR); Aurélien Hilary, Lannion (FR)

(73) Assignee: Alcatel Lucent, Boulogne-Billancourt (FR)

( * ) Notice: Subject to any disclaimer, the term of this patent is extended or adjusted under 35 U.S.C. 154(b) by 587 days.

(21) Appl. No.: 13/376,555

(22) PCT Filed: Jun. 11, 2010

(86) PCT No.: PCT/EP2010/058219

§ 371 (c)(1),
(2), (4) Date: Feb. 20, 2012

(87) PCT Pub. No.: WO2010/142780

PCT Pub. Date: Dec. 16, 2010

(65) Prior Publication Data

US 2012/0133567 A1 May 31, 2012

(30) Foreign Application Priority Data

Jun. 11, 2009 (FR) ..... 09 02838

(51) Int. Cl.
*H01Q 21/26* (2006.01)
*H01Q 21/28* (2006.01)
(Continued)

(52) U.S. Cl.
CPC ..... *H01Q 21/28* (2013.01); *H01Q 1/38* (2013.01); *H01Q 5/0075* (2013.01); *H01Q 9/28* (2013.01); *H01Q 21/26* (2013.01)
USPC ..... 343/798; 343/797

(58) Field of Classification Search
USPC ..... 343/798, 797, 800, 893
See application file for complete search history.

(56) References Cited

U.S. PATENT DOCUMENTS 3,196,443 A 7/1965 Martin
5,418,544 A 5/1995 Elliot
(Continued)

FOREIGN PATENT DOCUMENTS

FR 2 795 240 A 12/2000
JP S 59-194508 11/1984
(Continued)

OTHER PUBLICATIONS
International Search Report for PCT/EP2010/058219 dated Oct. 20, 2010.

*Primary Examiner* — Dieu H Duong
(74) *Attorney, Agent, or Firm* — Fay Sharpe LLP

(57) ABSTRACT

The subject of this invention is a multiband antenna radiating element comprising a first pair of cross-polarization dipoles each of which comprises two collinear conducting arms, whereby the four conducting arms define a first radiating plane corresponding to a low frequency band. The radiating element also consists of at least a second pair of cross-polarization dipoles each of which comprises two collinear conducting arms, whereby the four conducting arms define a second radiating plan corresponding to a higher frequency band. The first and second radiating planes are parallel; the second radiating plane is positioned above the first from which it is electrically insulated and the surface of the first radiating plane covering the conducting arms of the first pair of dipoles is larger than the surface of the second radiating plane covering the conducting arms of the second pair of dipoles. The first radiating plane can be defined by a first pair of dual cross-polarization dipoles or one printed circuit dipole and the second radiating plane can be defined by a second pair of dipoles chosen from cross dipoles, butterfly dipoles and printed circuit dipoles.

10 Claims, 4 Drawing Sheets

Figure 1:
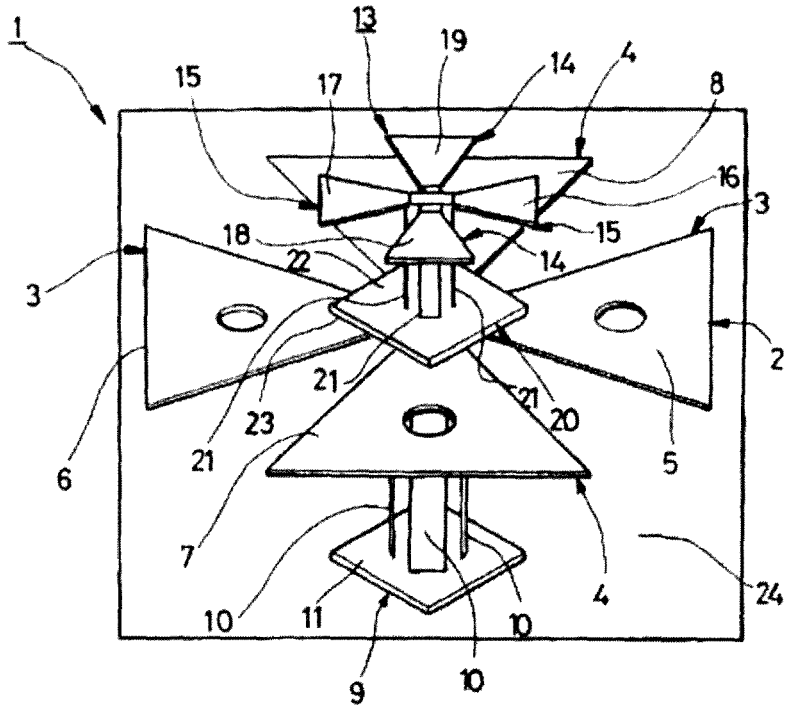

(51) Int. Cl.

| | |
|---|---|
| ***H01Q 1/38*** | (2006.01) |
| ***H01Q 5/00*** | (2006.01) |
| ***H01Q 9/28*** | (2006.01) |

(56) References Cited

U.S. PATENT DOCUMENTS

| | | | | |
|---|---|---|---|---|
| 6,342,866 | B1 | 1/2002 | Ho et al. | |
| 6,369,774 | B1 | 4/2002 | Lucidarme | |
| 7,230,579 | B2 | 6/2007 | De Ruijter | |
| 7,310,065 | B2 | 12/2007 | Anguera Pros et al. | |
| 7,855,690 | B2 | 12/2010 | Höök et al. | |
| 2003/0146872 | A1 | 8/2003 | Kellerman et al. | |
| 2006/0170604 | A1 | 8/2006 | Almog et al. | |
| 2006/0192718 | A1* | 8/2006 | Ando et al. | 343/773 |
| 2007/0008236 | A1* | 1/2007 | Tillery et al. | 343/797 |
| 2008/0001838 | A1* | 1/2008 | Huang et al. | 343/795 |
| 2009/0204372 | A1* | 8/2009 | Johnston et al. | 702/191 |

FOREIGN PATENT DOCUMENTS

| | | | |
|---|---|---|---|
| JP | H07-283651 | A | 10/1995 |
| JP | 2001-168637 | | 6/2001 |
| JP | 2002-043838 | | 2/2002 |
| JP | 2002-135031 | | 5/2002 |
| JP | 2004-242277 | | 8/2004 |
| JP | 2005-117099 | | 4/2005 |
| JP | 2005-0142298 | | 6/2005 |
| JP | 2005-533446 | | 11/2005 |
| JP | 2005-535209 | | 11/2005 |
| JP | 2009-100253 | | 5/2009 |
| JP | 2009-521830 | | 6/2009 |
| WO | WO 01/76012 | A | 10/2001 |
| WO | WO 2007/042938 | A | 4/2007 |

* cited by examiner

CROSS POLARIZATION MULTIBAND ANTENNA

This invention concerns a radiating element such as those which are present in multiband telecommunications antennas. It relates in particular to multiband antennas known as panel antennas which are used specifically in cellular telephone applications.

Cell telephony uses miscellaneous frequency bands corresponding to different known telecommunications systems. Several telecommunications systems are currently used simultaneously such as, for example, the "Global System for Mobile communications" GSM (870-960 MHz) and the "Universal Mobile Telephone Service" UMTS (1710-2170 MHz).

Telecommunications network operators must therefore have access to a network of antennas which transmit data on the various frequency bands used. Certain operators install additional antenna networks for this purpose, each of which operates on the basis of a telecommunications system. The operators therefore use a network of GSM antennas and a network of DCS antennas even though they install a network of UMTS antennas. However, when it comes to deploying their network, the operators find it difficult to obtain authorisation for the installation of new antennas. The current sites are already extremely overloaded in terms of their visual impact. Moreover, the increasing number of antenna networks is generating additional costs for operators (purchasing of antennas, renting of positions, installations) as well as environmental damage.

For all these reasons, operators are trying not to add to the number of antenna already installed. One solution to this problem would be to use multiband antennas based on a combination of radiating elements belonging to several telecommunications systems respectively within a single antenna chassis. These antennas incorporate several single band antennas in a reduced volume whilst maintaining the same service quality.

For example, there are two-frequency band or three-frequency band antennas in which radiating elements assigned to each frequency are aligned either parallel to each other according to a longitudinal periodic structure, for example staggered and alternating, so as to create a similar radioelectric environment for all radiating elements corresponding to the same frequency. These configurations significantly increase the width of the antenna and degrade the radiation performances, at least for the highest frequency. For both types of configuration, there is a strabismus effect of the azimuth diagram caused by asymmetry in the azimuth alignment plane of elements radiating at high frequency. A strong degradation in cross polarisation is also observed in the ±60° angular section due to this asymmetry.

A dual polarization radiating element consists of two independent dipoles each of which comprises two collinear conducting arms with a given polarization (positive or negative) to send and receive radiofrequency signals. The length of each arm is more or less equal to a quarter of the wavelength of the working wave. The radiating elements are assembled in a longitudinal alignment above a reflector which refines the directivity of the radiation pattern of the set created by reflecting the rear radiation of the dipoles. Each dipole of a radiating element is linked by a feed line to an external energy source. These radiating elements are dedicated to sending/receiving a single frequency.

A certain type of radiating element exists which comprises four more or less triangular conducting arms which are arranged orthogonally in relation to one another on a horizontal plane and which are known as a cross bow tie.

Another type of radiating element exists, known as a butterfly, which consists of four conducting arms folded axially in a V shape and arranged orthogonally in relation to one another.

There are also printed elements, also known as patch elements, which comprise four conducting arms marked by a conducting layer applied to a dielectric substrate.

The aim of this invention is, therefore, to provide a radiating element for a multiband antenna which is capable of reducing the space occupied.

This subject of this invention is a multiband antenna radiating element consisting of a first pair of dual cross-polarization dipoles each of which comprises two collinear conducting arms, whereby the four conducting arms define a first radiating plane corresponding to a low frequency band. The radiating element also consists of at least a second pair of cross-polarization dipoles each of which comprises two collinear conducting arms, whereby the four conducting arms define a second radiating plane corresponding to a higher frequency band. The first and second radiating planes are parallel; the second radiating plane is positioned above the first from which it is electrically insulated and the surface of the first radiating plane covering the conducting arms of the first pair of dipoles is larger than the surface of the second radiating plane covering the conducting arms of the second pair of dipoles.

It is necessary to superimpose two separate radiating planes, which are electrically insulated from one another, in parallel. The lower radiating plane, with a lower frequency, is designed to provide a sufficient surface for the upper radiating plane with a higher frequency so that it can be assimilated with a ground plane in relation to the upper radiating plane. This is obtained with as large as possible a surface covered with the dipoles of the lower radiating plane.

According to a first embodiment, the first radiating plane is defined by a pair of printed dipoles and the second radiating plane is defined by a pair of dipoles chosen from cross dipoles, butterfly dipoles and printed dipoles.

According to a second embodiment, the first radiating plane is defined by a pair of cross dipoles and the second radiating plane is defined by a pair of dipoles chosen from cross dipoles, butterfly dipoles and printed dipoles.

According to a first embodiment, the cross dipoles comprise triangular-shaped arms.

According to a second embodiment, the cross dipoles comprise square-shaped arms.

According to a third embodiment, the cross dipoles comprise arms made up of a solid fractal pattern.

According to a fourth embodiment, the cross dipoles comprise arms made up of separate strands. The strands should preferably be separated by a distance smaller than or equal to $\lambda_{HF}/10$ where $\lambda_{HF}$ is the wavelength of the high frequency RF signal.

In one variant embodiment, the radiating element comprises three parallel superimposed radiating planes: a first lower radiating plane, a second intermediate radiating plane positioned above the first radiating plane from which it is electrically insulated and a third upper radiating plane positioned above the second radiating plane from which it is electrically insulated.

A further aim of the invention is to provide a multiband telecommunications antenna comprising the radiating elements described above.

The advantage of this invention is that it reduces the width of the antenna and therefore its surface which reduces its manufacturing cost and provides it with a reduced wind surface area.

Moreover, the characteristics of the antenna comprising elements according to the invention are better than configurations in the prior art for two reasons. On the one hand, the radiating elements of one frequency band will be less disrupted by the radiating elements of the other frequency bands as the latter become "invisible" to them due to the position of the dipoles above one another. On the other hand, all the dipoles are in a symmetrical environment.

Figure 2:
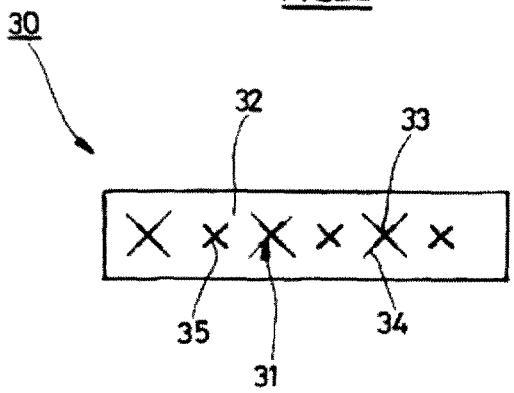
Figure 3:
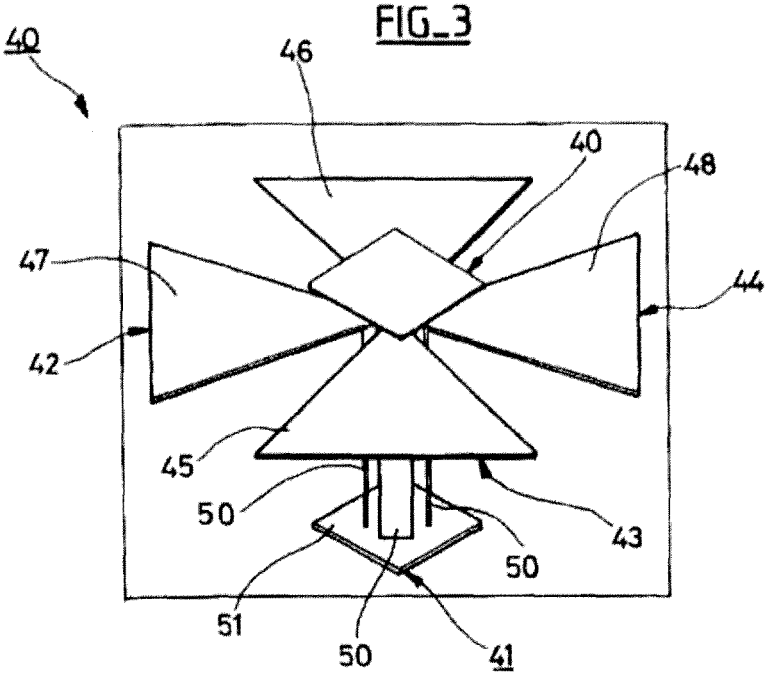
Figure 4:
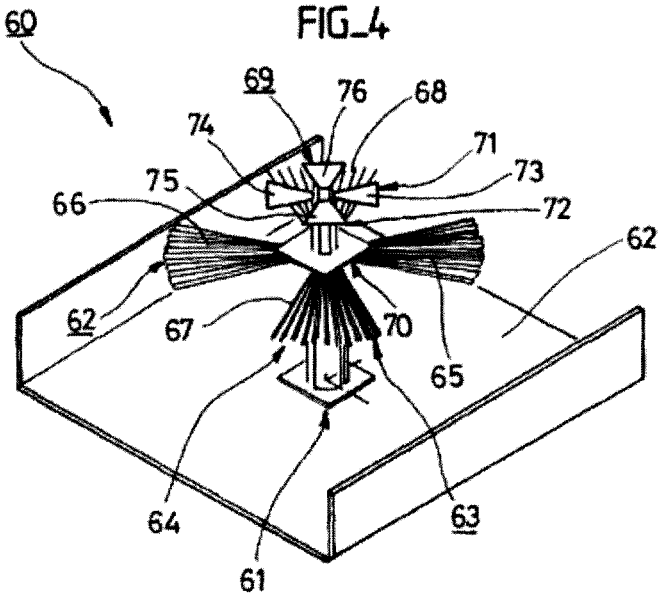
Figure 5:
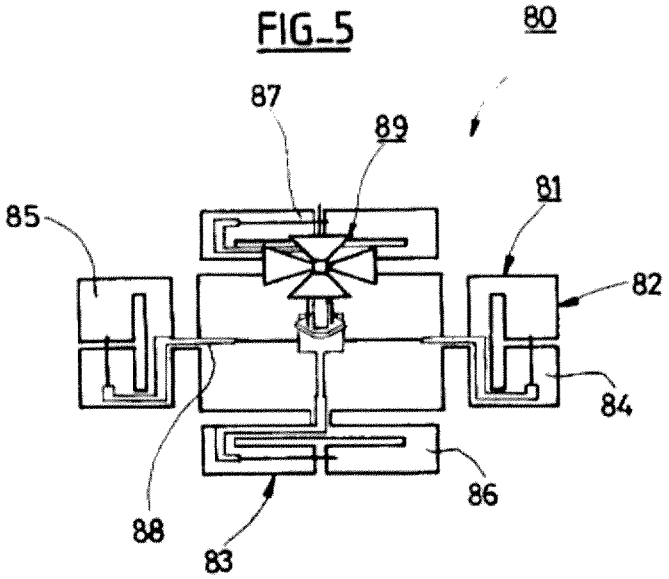
Figure 6:
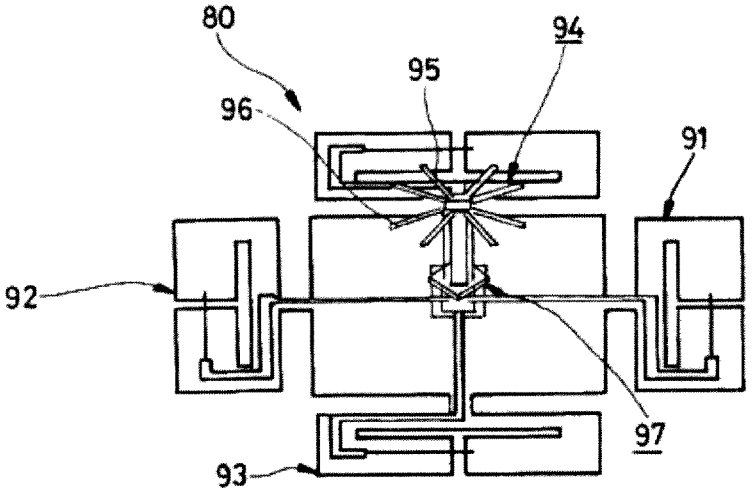
Figure 7:
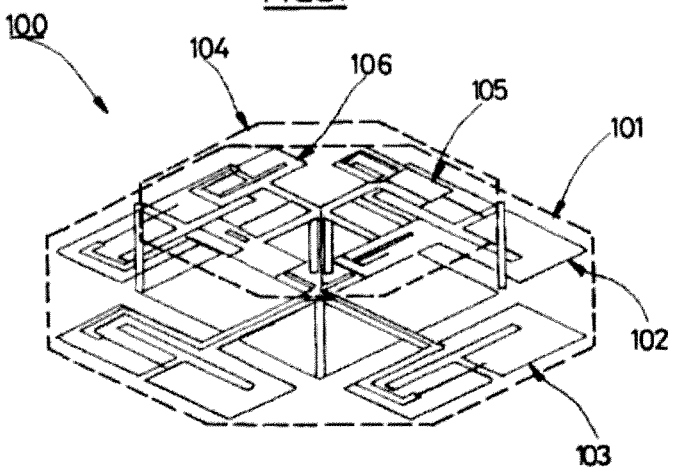
Figure 8:
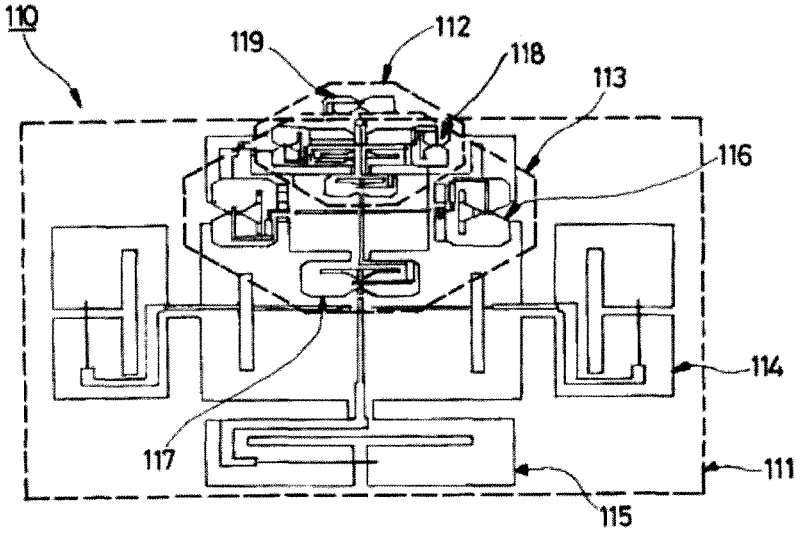

Other characteristics and advantages of the present invention will become apparent upon reading the following description of one embodiment, which is naturally given by way of a non-limiting example, and in the attached drawing, in which:

FIG. 1 represents a radiating element according to a first embodiment,

FIG. 2 shows a multiband antenna comprising radiating elements similar to those in FIG. 1, FIG. 3 represents a radiating element according to a second embodiment, FIG. 4 represents a radiating element according to a third embodiment, FIG. 5 represents a radiating element according to a fourth embodiment, FIG. 6 represents a radiating element according to a fifth embodiment, FIG. 7 represents a radiating element according to a sixth embodiment, FIG. 8 represents a radiating element according to a seventh embodiment, The embodiment illustrated in FIG. 1 represents a radiating element 1 comprising a lower radiating plane 2 defined by a first pair of cross dipoles consisting of a first dipole 3 and a second dual cross-polarization dipole 4 whose length is more or less equal to $\frac{1}{2}\lambda_{BF}$, where $\lambda_{BF}$ is the wavelength of the low frequency RF signal, arranged orthogonally in relation to one another presenting orthogonal polarizations of ±45°. The first dipole 3 comprises a first conducting arm 5 and a second conducting arm 6 which are collinear with a negative polarization (−45°), each with a length more or less equal to $\frac{1}{4}\lambda_{BF}$. Each conducting arm 5, 6 is more or less triangular in shape. The arms could naturally also adopt another shape (square for example). The first 5 and second 6 conducting arms are arranged as an extension of one another in a horizontal plane so that their apexes are close to one another without coming into contact. Similarly, the second dipole 4 comprises a first conducting arm 7 and a second conducting arm 8 which are collinear with a positive polarization (+45°). The conducting arms 7, 8 are more or less triangular in shape. The first 7 and second 8 conducting arms are arranged as an extension of one another in a horizontal plane so that their apexes are close to one another without coming into contact. The cross dipoles 3, 4 are supported by a base 9. The four conducting arms 5, 6, 7, 8 are all supported by a shaft 10 attached to a shared base plate 11 forming the base 9. Each dipole 3, 4 is provided with a balanced power supply to generate a linear polarization.

According to one embodiment of the invention, the radiating element 1 also comprises an upper radiating plane 13, similar for example to the lower radiating plane 2, defined by a second pair of cross dipoles consisting of a first dipole 14 and a second dual cross-polarization dipole 15 whose length is more or less equal to $\frac{1}{2}\lambda_{BF}$, where $\lambda_{BF}$ is the wavelength of the low frequency RF signal, arranged orthogonally in relation to one another presenting orthogonal polarizations of ±45°. The dipole 14 comprises a first conducting arm 16 and a second conducting arm 17 which are collinear with a negative polarization (−45°) and the dipole 15 comprises a first conducting arm 18 and a second conducting arm 19 which are collinear with a positive polarization (+45°). The arms 16, 17, 18, 19 are more or less triangular in shape and arranged as extensions of one another in a horizontal plane. The cross dipoles 14, 15 are supported by a base 20. All the conducting arms 16, 17, 18, 19 are supported by a shaft 21 attached to a shared base plate 22 forming the base 20. Each dipole 14, 15 is provided with a balanced power supply to generate a linear polarization.

The lower plane 2 is assembled on a flat reflector 24 which serves as a ground plane through the intermediary of its base plate 11. The upper radiating plane 13 is positioned above the lower plane 2 from which it is electrically insulated, for example by a layer of dielectric material 23 and is attached to the latter by means of its base plate 20. The conducting arms 5, 6, 16, 17 with negative polarization (−45°)are superimposed as are the conducting arms 7, 8, 18, 19 with positive polarization (+45°). In this case, the conducting arms 5, 6, 7, 8 of the dipoles 3, 4 on the lower plane 2 have a metallic surface which is sufficiently developed to serve as an RF energy reflector for the upper plane 13.

FIG. 2 illustrates a beneficial embodiment of a telecommunications antenna 30 comprising radiating elements 31 assembled on a reflector 32. The radiating element 31 comprises an upper radiating plane 33 dedicated to the UMTS frequency band and a lower radiating plane 34 dedicated to the GSM frequency band. The antenna 30 may also comprise elements including a radiating plane 35, similar to the upper radiating plane 33, dedicated to the UMTS frequency band, which are interspersed between the radiating elements 31. The radiating planes 35 and 33 must either be physically positioned at the same height or be compensated for electrically by the addition of a cable in order to generate a flat wavefront.

FIG. 3 presents a second embodiment of a radiating element 40 comprising a base 41 mounted beneath a radiating plane 42. The lower radiating plane 42 is defined by a first pair of cross dipoles made up of two dipoles 43 and 44 with dual cross polarization. The dipole 43 with negative polarization (−45°) comprises a first conducting arm 45 and a second conducting arm 46 and the dipole 44 with positive polarization (+45°) comprises a first conducting arm 47 and a second conducting arm 48. An upper radiating plane 49 defined by a first pair of dual polarization printed or metallic dipoles, known as patch type dipoles, is mounted beneath the lower radiating plane 42 from which it is electrically insulated. As stated above, the conducting arms 45, 46, 47, 48 are all supported by a shaft 50 attached to a base plate 51. Each dipole 43, 44 is therefore provided with a balanced power supply to generate a linear polarization.

FIG. 4 depicts a third embodiment of a radiating element according to the invention. The radiating element 60 comprises a base 61 supporting a lower radiating plane 62 defined by a first pair of cross dual polarization dipoles consisting of a first dipole 63 and a second dipole 64 arranged in a cross shape, each with two arms 65, 66 and 67, 68 respectively. Each arm 65, 68, 67, 68 is made up of separate strands whose length is more or less equal to $\frac{1}{4}\lambda_{BF}$, where $\lambda_{BF}$ is the wavelength of the low frequency RF signal. The strands are separated by a distance smaller than or equal to $\lambda_{HF}/10$, where $\lambda_{HF}$ is the wavelength of the high frequency RF signal.

An upper radiating plane 69 is superimposed on the lower radiating plane 62 from which it is electrically insulated. The upper radiating plane 69 is defined by a second pair of dual cross-polarization dipoles supported by a base 70, a first dipole 71 and a second dipole 72 arranged in a cross shape, each with two arms 73, 74 and 75, 76 respectively which are more or less triangular in shape and arranged as an extension of one another in a horizontal plane.

It may be possible in a similar way to create radiating elements consisting of a different number of superimposed radiating planes, for example a lower radiating plane, an intermediate radiating plane and an upper radiating plane. In this case, the lower radiating plane must naturally embody the same characteristics with regard to the intermediate plane as the ones which have already been described in relation to the upper radiating plane. Similarly, the intermediate radiating plane must embody the same characteristics with regard to the upper radiating plane as the ones which have already been described in relation to the lower radiating plane.

The radiating element 80 represented in FIG. 5 is a fourth embodiment of a radiating element according to the invention. The radiating element 80 comprises a lower radiating plane 81 defined by a first pair of dipoles, which is a printed circuit forming dipoles 82 and 83 each of which possesses two arms 84, 85 and 86, 87 respectively fed by a conductive line 88. A radiating plane 89 defined by a second pair of dual cross-polarization dipoles is superimposed on the lower radiating plane 81 from which it is electrically insulated. The upper radiating plane 89 comprises two cross dipoles supported by a base similar to the upper radiating plane 69 in FIG. 4 which has already been described.

FIG. 6 depicts a fifth embodiment of a radiating element according to the invention. The radiating element 90 comprises a lower radiating plane 91 defined by a first pair of dipoles which is a printed circuit forming dipoles 92 and 93 in a cross shape similar to the lower radiating plane 81 in FIG. 5 which has already been described. A radiating plane 94 defined by a second pair of cross dipoles is superimposed on the lower radiating plane 91 from which it is electrically insulated. The upper radiating plane 94 comprises two cross dipoles 95, 96 of the "butterfly" type which are arranged orthogonally and supported by a base 97. Each dipole 95, 96 consists of two conducting arms folded axially in a V shape.

FIG. 7 depicts a seventh embodiment of a radiating element according to the invention. The radiating element 100 comprises a lower radiating plane 101 defined by a first pair of dipoles which is a printed circuit forming dipoles 102 and 103 in a cross shape similar to the lower radiating plane 81 in FIG. 5 which has already been described. An upper radiating plane 104 is superimposed on the lower radiating plane 101 from which it is electrically insulated. The upper radiating plane 104 is a printed circuit forming dipoles 105 and 106 in a cross shape.

It may be possible in a similar way to create radiating elements consisting of a different number of radiating planes. For example, a radiating element 110 comprising a lower radiating plane 111, an intermediate radiating plane 112 and an upper radiating plane 113 superimposed as shown in FIG. 8. In this case, the lower radiating plane 111 must naturally embody the same characteristics with regard to the intermediate plane 112 as the ones which have already been described in relation to the upper radiating plane 113. Similarly, the intermediate radiating plane 112 must embody the same characteristics with regard to the upper radiating plane 113 as the ones which have already been described in relation to the lower radiating plane 111.

The lower radiating plane 111, defined by a first pair of dipoles, is a printed circuit forming dipoles 114 and 115 in a cross shape similar to the lower radiating plane 81 in FIG. 5 which has already been described. An intermediate radiating plane 112 defined by a second pair of cross dipoles is superimposed on the lower radiating plane 111 from which it is electrically insulated. The intermediate radiating plane 112 is also a printed circuit forming dipoles 116 and 117 in a cross shape. An upper radiating plane 113, defined by a third pair of dipoles, is superimposed on the intermediate radiating plane 112 from which it is electrically insulated. The upper radiating plane 113 is also a printed circuit forming dipoles 118 and 119 in a cross shape.

The invention claimed is:

1. A radiating element for a multi-band antenna, the radiating element comprising:

a reflector oriented to lie within a reflector plane;

a first pair of dipoles, each dipole of the first pair of dipoles having two collinear conductive arms, the dipoles of the first pair being oriented orthogonally relative to each other and to lie substantially within a first radiator plane; and a second pair of dipoles, electrically insulated from the first pair of dipoles, each dipole of the second pair of dipoles having two collinear conductive arms, the dipoles of the second pair being oriented orthogonally relative to each other and to lie substantially within a second radiator plane, wherein the reflector plane, first radiator plane and second radiator plane are substantially parallel to each other, wherein the first radiator plane lies between the reflector plane and the second radiator plane, wherein a conductive surface area of the conductive arms of the first pair of dipoles is larger than a conductive surface area of the conductive arms of the second pair of dipoles and wherein the conductive surface area of the conductive arms of the first pair serves as a reflector for the second pair of dipoles.

2. The radiating element according to claim 1, wherein the first pair of dipoles comprises a pair of printed dipoles and the second pair of dipoles comprises a pair of dipoles chosen from cross dipoles, butterfly dipoles and printed dipoles.

3. The radiating element according to claim 2, wherein the first pair of dipoles comprise cross dipoles and the second pair of dipoles comprise one of cross dipoles and butterfly dipoles.

4. The radiating element according to claim 2, wherein the second pair of dipoles comprise cross dipoles having triangular arms.

5. The radiating element according to claim 2, wherein the second pair of dipoles comprise cross dipoles having arms made up of a solid fractal pattern.

6. The radiating element according to claim 2, wherein the second pair of dipoles comprise cross dipoles having arms made up of separate strands.

7. The radiating element according to claim 6 wherein the strands are separated by a distance smaller than or equal to $\lambda_{HF}/10$ where $\lambda_{HF}$ is the wavelength of a higher frequency RF signal at which the second pair of dipoles is designed to be used.

8. The radiating element according to claim 1, wherein the first pair of dipoles comprises a pair of cross dipoles and the second pair of dipoles comprises a pair of dipoles chosen from cross dipoles, butterfly dipoles and printed dipoles.

9. The radiating element according to claim 1 comprising a third pair of dipoles, electrically insulated from the second pair of dipoles, the dipoles of the third pair being oriented orthogonally relative to each other and to lie substantially within a third radiator plane, wherein the third radiator plane and second radiator plane are substantially parallel to each other and the third radiator plane is spaced further from the first radiator plane than from the second radiator plane on a same side of the reflector plane as the first and second radiator planes, wherein a conductive surface area of the conductive arms of the second pair of dipoles is larger than a conductive surface area of the conductive arms of the third pair of dipoles and wherein the conductive surface area of the conductive arms of the second pair serves as a reflector for the third pair of dipoles.

10. A multiband antenna comprising:

a radiating element comprising:

a reflector oriented to lie within a reflector plane;

a first pair of dipoles designed for a GSM frequency band, each dipole of the first pair of dipoles having two collinear conductive arms, the dipoles of the first pair being oriented orthogonally relative to each other and to lie substantially within a first radiator plane; and a second pair of dipoles designed for a UMTS frequency band, the second pair of dipoles being electrically insulated from the first pair of dipoles, each dipole of the second pair of dipoles having two collinear conductive arms, the dipoles of the second pair being oriented orthogonally relative to each other and to lie substantially within a second radiator plane, wherein the reflector plane, first radiator plane and second radiator plane are substantially parallel to each other, wherein the first radiator plane lies between the reflector plane and the second radiator plane, wherein a conductive surface area of the conductive arms of the first pair of dipoles is larger than a conductive surface area of the conductive arms of the second pair of dipoles and wherein the conductive surface area of the conductive arms of the first pair serves as a reflector for the second pair of dipoles.

* * * * *